US011891944B2

(12) United States Patent
Desai et al.

(10) Patent No.: US 11,891,944 B2
(45) Date of Patent: Feb. 6, 2024

(54) SYSTEMS AND METHODS FOR ENGINE COOLANT TEMPERATURE CONTROL

(71) Applicant: Cummins Inc., Columbus, IN (US)

(72) Inventors: Mihir Desai, Seymour, IN (US); Luke T. Jennings, Columbus, IN (US); Robert J. Thomas, Indianapolis, IN (US)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 17/914,092

(22) PCT Filed: Mar. 23, 2021

(86) PCT No.: PCT/US2021/023600
§ 371 (c)(1),
(2) Date: Sep. 23, 2022

(87) PCT Pub. No.: WO2021/195029
PCT Pub. Date: Sep. 30, 2021

(65) Prior Publication Data

US 2023/0124692 A1 Apr. 20, 2023

Related U.S. Application Data

(60) Provisional application No. 62/994,029, filed on Mar. 24, 2020.

(51) Int. Cl.
*F01P 7/16* (2006.01)
*F01P 7/14* (2006.01)

(52) U.S. Cl.
CPC ..... *F01P 7/167* (2013.01); *F01P 2007/146* (2013.01); *F01P 2025/30* (2013.01); *F01P 2025/32* (2013.01); *F01P 2025/62* (2013.01)

(58) Field of Classification Search
CPC ..... F01P 2025/62; F01P 2025/32; F01P 2025/30; F01P 2007/146; F01P 7/167
See application file for complete search history.

(56) References Cited

U.S. PATENT DOCUMENTS 4,545,333 A 10/1985 Nagumo et al.
8,430,068 B2 4/2013 Harris et al.
9,188,053 B2 11/2015 Abihana
(Continued)

FOREIGN PATENT DOCUMENTS

JP 2003074350 A * 3/2003

OTHER PUBLICATIONS

International Search Report and Written Opinion on PCT App. No. PCT/US2021/023600 dated Jun. 8, 2021, 8 pages.

*Primary Examiner* — Kevin A Lathers
(74) *Attorney, Agent, or Firm* — FOLEY & LARDNER LLP

(57) ABSTRACT

A controller includes at least one processor coupled to a memory storing instructions that, when executed by the at least one processor, cause the at least one processor to: determine a target engine outlet coolant temperature for a coolant in an engine system; determine an adjustment to a temperature of the coolant based on a determined engine inlet coolant temperature and the target engine outlet coolant temperature; and, alter a flow of the coolant by controlling a coolant valve in response to the determination of the adjustment to the temperature of the coolant.

17 Claims, 5 Drawing Sheets

(56) References Cited

U.S. PATENT DOCUMENTS

| | | | |
|---|---|---|---|
| 9,599,010 | B2 | 3/2017 | Ichihara et al. |
| 10,180,101 | B1 * | 1/2019 | Park ..... F01P 11/16 |
| 10,316,731 | B2 | 6/2019 | Park et al. |
| 2006/0196451 | A1 | 9/2006 | Braun et al. |
| 2015/0198133 | A1 | 7/2015 | Ballard et al. |
| 2018/0073421 | A1 | 3/2018 | Hutchins |
| 2020/0040805 | A1 | 2/2020 | Kim et al. |

* cited by examiner

| Engine Load (Kilowatt) | Coolant Temperature dT (Degrees Celsius) |
|---|---|
| 0 | 1 |
| 250 | 2 |
| 500 | 3 |
| 750 | 4 |
| 1000 | 5 |
| 1250 | 6.5 |
| 1500 | 8 |
| 1750 | 9 |
| 2000 | 10 |

SYSTEMS AND METHODS FOR ENGINE COOLANT TEMPERATURE CONTROL

CROSS-REFERENCE TO RELATED APPLICATION

This application claims the benefit of and priority to U.S. Pat. App. No. 62/994,029, titled "SYSTEMS AND METHODS FOR ENGINE COOLANT TEMPERATURE CONTROL," filed Mar. 24, 2020, which is incorporated herein by reference in its entirety and for all purposes.

TECHNICAL FIELD

The present disclosure relates to systems and methods for controlling a coolant temperature for engine systems.

BACKGROUND

An engine system may include a coolant system that helps regulate the temperature of the engine during operation. In operation, coolant is circulated through the engine to remove generated heat. The heated coolant passes through a heat exchanger, radiator, or other cooling device where the absorbed heat is released thereby cooling the coolant. This process is then repeated where the cooled coolant is circulated back through the engine (or other parts of the system) to remove accumulated heat.

SUMMARY

One embodiment relates to a system that includes a controller including at least one processor coupled to a memory storing instructions that, when executed by the at least one processor, cause the at least one processor to: determine a target engine outlet coolant temperature for a coolant in an engine system; determine an adjustment to a temperature of the coolant based on a determined engine inlet coolant temperature and the target engine outlet coolant temperature; and alter a flow of the coolant by controlling a coolant valve in response to the determination of the adjustment to the temperature of the coolant.

Another embodiment relates to a method. The method includes: determining a target engine outlet coolant temperature for a coolant in an engine system; determining an amount of adjustment to a temperature of the coolant based on a determined engine inlet coolant temperature and the target engine outlet coolant temperature; and, altering a flow of the coolant by controlling a coolant valve in response to the determination of the adjustment to the temperature of the coolant.

Yet another embodiment relates to a non-transitory computer readable medium. The non-transitory computer readable medium has computer-executable instructions embodied therein that, when executed by a computing system, causes the computing system to perform operations, the operations comprising: determining a target engine outlet coolant temperature for a coolant in an engine system; determining an adjustment to a temperature of the coolant based on a determined engine inlet coolant temperature and the target engine outlet coolant temperature; and altering a flow of the coolant by controlling a coolant valve in response to the determination of the amount of adjustment to the temperature of the coolant.

This summary is illustrative only and is not intended to be in any way limiting. Other aspects, inventive features, and advantages of the devices or processes described herein will become apparent in the detailed description set forth herein, taken in conjunction with the accompanying figures, wherein like reference numerals refer to like elements.

DETAILED DESCRIPTION

Figure 1:
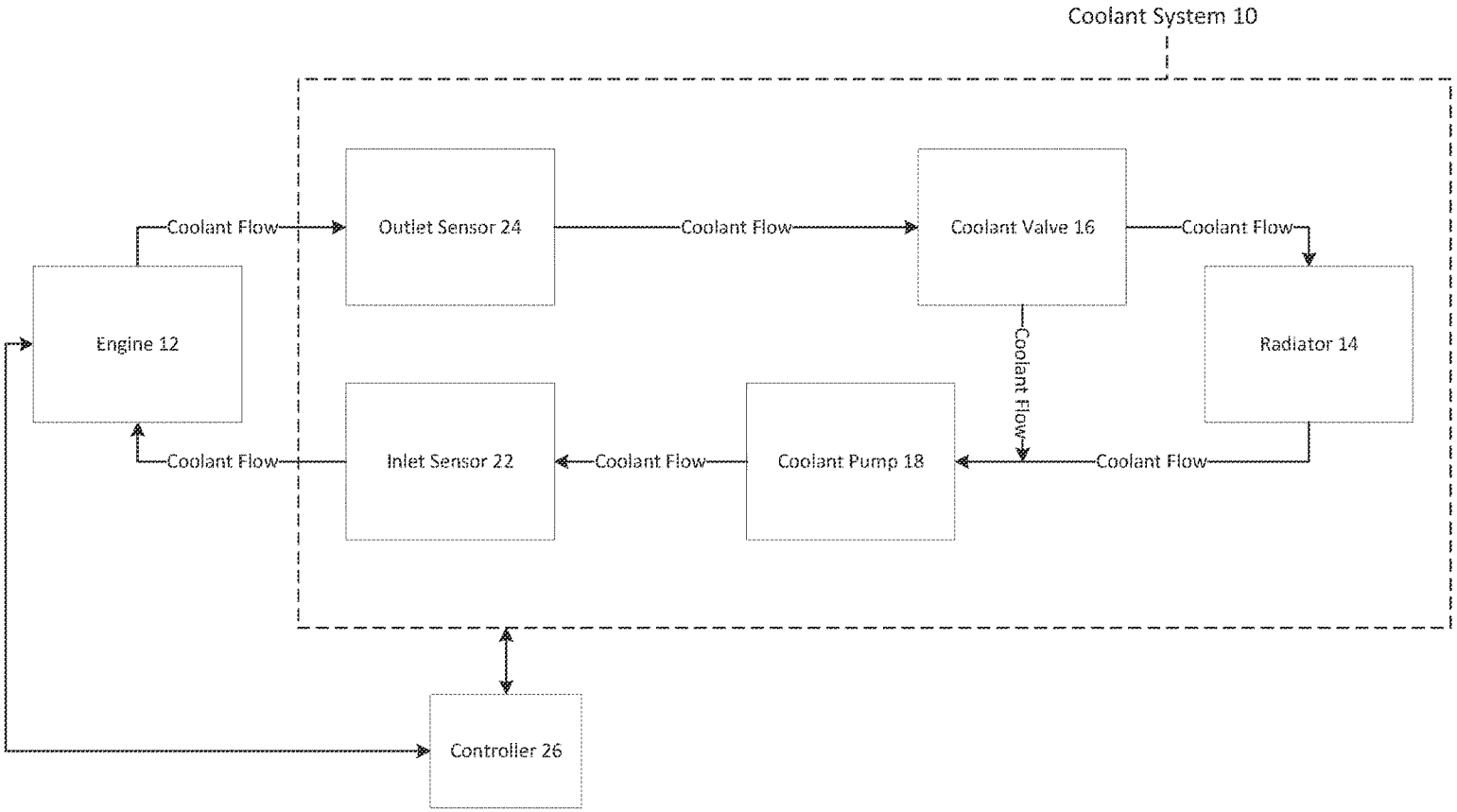
FIG. 1 is a schematic diagram of a coolant system and an engine, according to an example embodiment.

Following below are more detailed descriptions of various concepts related to, and implementations of, methods, apparatuses, and systems for obtaining and maintaining a target engine outlet coolant temperature based on both engine inlet coolant and engine outlet coolant temperature. Before turning to the figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting. In particular, although the specification refers to the target engine outlet coolant temperature, which is defined as a sensed temperature of a coolant at an outlet of an engine, the systems and methods, as described herein, should not be read as limited to such and should be read as applicable to a target temperature of the coolant as sensed at any location within the coolant system.

Referring to the Figures generally, the various embodiments disclosed herein relate to systems, apparatuses, and methods for obtaining and maintaining a target engine outlet coolant temperature based on both engine inlet coolant temperature, which is defined as a temperature of a coolant as the coolant is entering an engine, and engine outlet coolant temperature, which is defined as a temperature of the coolant as the coolant is exiting the engine. In a liquid-cooled engine system, the temperature of the engine may be regulated through the use of a coolant system that pumps, drives, guides, or otherwise circulates coolant through and around the engine thereby ensuring that the engine does not overheat. As the coolant is pumped through and around the engine, the coolant absorbs heat from the engine, thereby reducing the temperature of the engine during operation while increasing the temperature of the coolant. Traditionally, to track the effectiveness of the coolant system, the temperature of the high temperature coolant is measured as the coolant exits the engine (i.e. at an outlet of the engine). If the high temperature coolant at the engine system outlet is too hot, the temperature of the coolant is reduced by routing the coolant through a radiator, which cools the coolant.

However, this method of tracking the high temperature coolant at the outlet of the engine often leads to unreliable results, such as an overshooting of the target coolant temperature. Because the temperature of the coolant is only measured as the coolant leaves the engine but the coolant system adjusts the temperature of the coolant at the entry to the engine (i.e. an inlet to the engine from a radiator), reading the results of the coolant adjustments is done on a delay equal to the coolant's time of travel through the engine. As such, when the temperature readings at the outlet have reached a target value, adjustments are still being made the coolant at the inlet and the temperature readings at the outlet will continue to change, necessitating a correction in the opposite direction at the inlet.

Ensuring that the engine is operating at the proper temperature is important to engine and overall system performance (e.g., generator-set, vehicle, etc.). An engine that is running hot can cause permanent damage to the engine itself and to peripheral components (e.g., exhaust manifold, catalytic converters, etc.). As such, engine systems often include fail-safe features to avoid overheating, such as de-rate or shutdown protocols which may promote long-term health but hinder short-term performance. Additionally, an engine that is running cold may suffer from, among other detriments, inefficient fuel economy. Therefore, maintaining a target operating temperature in the engine system is important to both short-term performance and long-term engine health.

The present disclosure relates to a coolant system for an engine system that monitors the coolant temperature at both the outlet and the inlet of the engine and controls, via a controller, coolant system performance based on a feedback loop with the engine outlet temperature and engine inlet temperature as inputs. By including the engine inlet coolant temperature, which is more instantaneously responsive to changes in coolant temperature, and utilizing a feedback loop, which improves the control process by learning from past changes, the coolant system is better able to achieve and maintain a target engine outlet coolant temperature at the engine without overshoot than traditional systems. These and other features and benefits are described more fully herein below.

As shown in FIG. 1, a coolant system 10 with radiator 14, coolant valve 16, coolant pump 18, inlet sensor 22, and outlet sensor 24, an engine 12, and a controller 26 are shown. The engine 12 may be any type of engine that uses a coolant to maintain a target operating temperature. Thus, the engine 12 may include as an internal combustion engine (e.g., gasoline, natural gas, or diesel engines), a hybrid engine (e.g., a combination of an internal combustion engine and an electric motor), and/or any other suitable engine. The engine 12 may also be any type of engine that is structured for cogeneration (i.e. combined heat and power, or CHP), such that heat generated by the engine 12 is captured by the engine system and utilized. In this exemplary embodiment, the coolant system 10 and engine 12 are part of a stationary piece of equipment, such as a power generator or genset. However, in other embodiments, the coolant system 10 may be implemented with an on-road or an off-road vehicle including, but not limited to, line-haul trucks, mid-range trucks (e.g., pick-up truck, etc.), sedans, coupes, tanks, airplanes, boats, and any other type of vehicle. Based on these configurations, various additional types of components may also be included in the system, such as a transmission, one or more gearboxes, pumps, actuators, and so on.

The coolant may be any type of heat transfer fluid that is capable of absorbing heat from the engine 12, such as water, inorganic additive technology, organic additive technology, hybrid organic acid technology, oil, glycol-based fluids, etc. The radiator 14 is a heat exchanger for cooling fluid (e.g. coolant) within the coolant system 10. In some embodiments, the radiator includes a cooling fan that increases the cooling rate of fluid that passes through the radiator. The radiator 14 is coupled to the engine 12 and structured to receive coolant from the engine 12. In this exemplary embodiment, the coolant valve 16 is a three-way coolant valve such that the coolant valve 16 is structured to receive coolant from the engine 12 and to direct the coolant either back to the engine 12 or to the radiator 14. The coolant pump 18 is disposed upstream of the engine 12 and directs coolant from either the coolant valve 16 or the radiator 14 towards and into the engine 12. The coolant valve 16 may be any type of valve suitable for receiving hot coolant from engine and selectively diverting coolant back to the engine or radiator (e.g., thermostatic three-way valve, electrical or other actuated three-way valve, a suitable non-three-way valve, etc.). Similarly, the coolant pump 18 may be any type of pump used in a coolant system.

In operation, coolant is pumped by the coolant pump 18 into the engine 12 at an inlet (i.e. a "cold side"). Then, the coolant passes through the engine 12 and absorbs heat that the engine 12 produces during operation thereby lowering a temperature of the engine 12 and raising the temperature of the coolant. The coolant exits the engine 12 at an outlet (i.e. a "hot side") and flows into the coolant valve 16. Based on analysis and direction from the controller 26 (which will be discussed herein below), the coolant valve 16 directs a quantity of the coolant to the coolant pump 18 to be pumped back into the engine 12 without flowing through the radiator 14 and a quantity of the coolant to the radiator 14 to be cooled. If the coolant is directed to the radiator 14, the radiator 14 reduces the temperature of the coolant through at least one of exposure to outside air or the cooling fan. The coolant, after being cooled by the radiator 14, flows back to the coolant pump 18 to be pumped into the engine 12 and the flow process repeats itself.

In an alternative embodiment (not shown), the coolant valve 16 is downstream from the radiator 14 and upstream from the coolant pump 18 (i.e., between the pump 18 and the radiator 14), such that the coolant valve 16 is structured to combine cooled coolant from the radiator 14 with hot coolant from the engine 12. Where or approximately where the coolant valve 16 is pictured in FIG. 1 is replaced with a fluid diversion device and, particularly, a T-junction. In operation of this embodiment, coolant is pumped by the coolant pump 18 into the engine at the inlet (i.e. the cold side). Then, the coolant passes through the engine 12 and absorbs heat that the engine 12 produces during operation, thereby lowering a temperature of the engine 12 and raising the temperature of the coolant. The coolant exits the engine at the outlet (i.e. the hot side) and flows in the T-junction. Some of the hot coolant is directed to the radiator 14 while other hot coolant bypasses the radiator and goes directly to the coolant valve 16. The coolant that flows into the radiator 14 is exposed to at least one of outside air or the cooling fan, and the temperature of that coolant is reduced. The coolant valve 16 then "mixes" a quantity of the hot coolant from the engine 12 and a quantity of the cooled coolant from the radiator, based on analysis and direction from the controller 26 (which is discussed herein below). In these embodiments, the coolant valve 16 may be referred to as a "mixing valve."

The inlet sensor 22 is disposed or positioned on a cold side of the engine 12 where "cold" is used to signify that the coolant has not yet been circulated through the engine to absorb heat. The inlet sensor 22 (inlet coolant sensor, first sensor, etc.) is structured to sense at least one characteristic regarding the coolant as the coolant is entering the engine 12. The outlet sensor 24 is disposed or positioned on a hot side of the engine 12 where "hot" is used to signify that the coolant has now circulated through the engine and has absorbed heat. The outlet sensor 24 (outlet coolant sensor, second sensor, etc.) is structured to sense at least one characteristic regarding the coolant as the coolant is leaving the engine 12. Thus, the inlet sensor 22 and outlet sensor 24 may be one or more sensors arranged to measure or otherwise acquire data, values, or information regarding the characteristics or attributes of the coolant. The sensors may be all real sensors, all virtual sensors, or a combination thereof. In some embodiments, the inlet sensor 22 and the outlet sensor 24 are or include a temperature sensor structured to send a signal to the controller 26 indicative of the temperature of the coolant as it flows through or proximate to the inlet sensor 22 and the outlet sensor 24. In another embodiment, the inlet and outlet sensors 22 and 24 include flow sensors that track the flow rate of the coolant entering and exiting the engine. In still another embodiment, the inlet and outlet sensors 22 and 24 are structured as pressure sensors. In yet a further embodiment, the inlet and outlet sensors 22 and 24 are structured as a combination of temperature, flow rate, and/or pressure sensors. In one embodiment and as shown, the inlet sensor 22 is positioned immediately upstream from the engine 12 and senses, for example, the coolant temperature before the coolant is applied/circulated through the engine 12. Also in this embodiment, the outlet sensor 24 is positioned immediately downstream from the engine 12 and senses, for example, the coolant temperature after the coolant leaves the engine 12.

The controller 26 is coupled to the engine 12 and the coolant system 10 and is structured to at least partly control the coolant system 10 and, in some embodiments, the engine 12. When the sensors are structured as real sensors, the controller 26 receives signals from the inlet sensor 22 and from the outlet sensor 24 and uses the signals received from the inlet sensor 22 and from the outlet sensor 24 to analyze the temperature of the coolant in the coolant system and perform various operations or actions in response to these signals. The controller 26 also receives signals from the engine 12 regarding performance and operation of the engine 12.

As the components of FIG. 1 are shown to be embodied in the coolant system 10, the controller 26 may be structured as one or more electronic control units (ECU), which may include one or more programmable logic controllers (PLC). The function and structure of the controller 26 are described in greater detail in FIG. 2.

Figure 2:
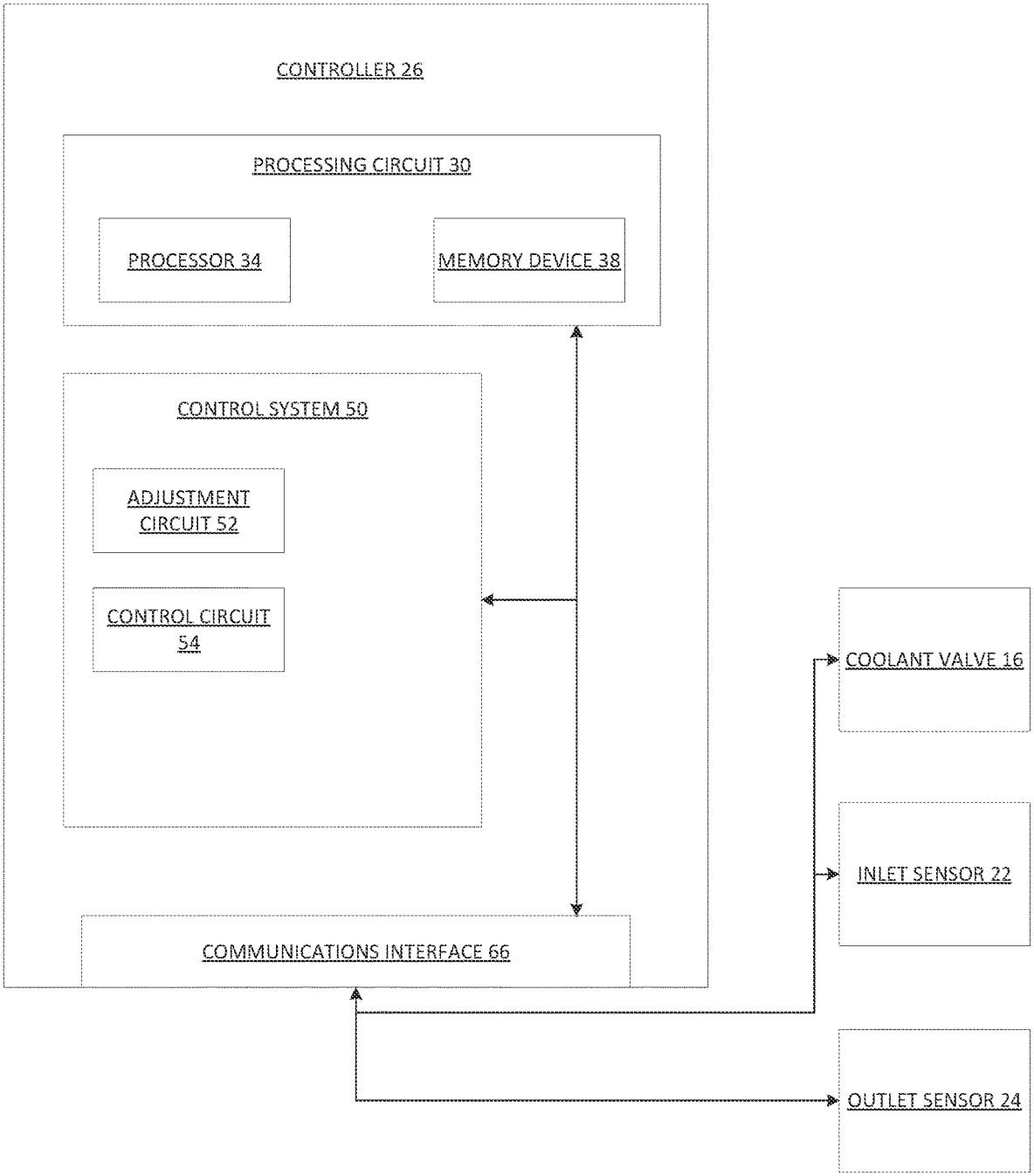
FIG. 2 is a schematic view of a controller of the coolant system of FIG. 1, according to an example embodiment.

Referring now to FIG. 2, a schematic diagram of the controller 26 of the coolant system 10 of FIG. 1 is shown according to an example embodiment. As shown in FIG. 2, the controller 26 includes a processing circuit 30 having a processor 34 and a memory device 38, a control system 50 having an adjustment circuit 52 and a control circuit 54, and a communications interface 66. Generally, the controller 26 is structured to communicate with and control, at least parts thereof, of the coolant system 10 in order to regulate and control performance of the coolant system 10 through controlling the coolant valve 16 in response to signals from the inlet sensor 22 and the outlet sensor 24.

In one configuration, the adjustment circuit 52 and the control circuit 54 are embodied as machine or computer-readable media that is executable by a processor, such as processor 34. As described herein and amongst other uses, the machine-readable media facilitates performance of certain operations to enable reception and transmission of data. For example, the machine-readable media may provide an instruction (e.g., command, etc.) to, e.g., acquire data. In this regard, the machine-readable media may include programmable logic that defines the frequency of acquisition of the data (or, transmission of the data). The computer readable media may include code, which may be written in any programming language including, but not limited to, Java or the like and any conventional procedural programming languages, such as the "C" programming language or similar programming languages. The computer readable program code may be executed on one processor or multiple remote processors. In the latter scenario, the remote processors may be connected to each other through any type of network (e.g., CAN bus, etc.).

In another configuration, the adjustment circuit 52 and the control circuit 54 are embodied as hardware units, such as electronic control units. As such, the adjustment circuit 52 and the control circuit 54 may be embodied as one or more circuitry components including, but not limited to, processing circuitry (one or more processors and memory devices), network interfaces, peripheral devices, input devices, output devices, sensors, etc. In some embodiments, the adjustment circuit 52 and the control circuit 54 may take the form of one or more analog circuits, electronic circuits (e.g., integrated circuits (IC), discrete circuits, system on a chip (SOCs) circuits, microcontrollers, etc.), telecommunication circuits, hybrid circuits, and any other type of circuit. In this regard, the adjustment circuit 52 and the control circuit 54 may include any type of component for accomplishing or facilitating achievement of the operations described herein. For example, a circuit as described herein may include one or more transistors, logic gates (e.g., NAND, AND, NOR, OR, XOR, NOT, XNOR, etc.), resistors, multiplexers, registers, capacitors, inductors, diodes, wiring, and so on). The adjustment circuit 52 and the control circuit 54 may also include programmable hardware devices such as field programmable gate arrays, programmable array logic, programmable logic devices or the like. The adjustment circuit 52 and the control circuit 54 may include one or more memory devices for storing instructions that are executable by the processor (s) of the adjustment circuit 52 and the control circuit 54. The one or more memory devices and processor(s) may have the same definition as provided below with respect to the memory device 38 and processor 34. In some hardware unit configurations, the adjustment circuit 52 and the control circuit 54 may be geographically dispersed throughout separate locations of the system (e.g., the genset or the vehicle). Alternatively and as shown, the adjustment circuit 52 and the control circuit 54 may be embodied in or within a single unit/housing, which is shown as the controller 26.

In the example shown, the controller 26 includes the processing circuit 30 having the processor 34 and the memory device 38. The processing circuit 30 may be structured or configured to execute or implement the instructions, commands, and/or control processes described herein with respect to adjustment circuit 52 and the control circuit 54. The depicted configuration represents the adjustment circuit 52 and the control circuit 54 as machine or computer-readable media. However, as mentioned above, this illustration is not meant to be limiting as the present disclosure contemplates other embodiments where the adjustment circuit 52 and the control circuit 54, or at least one circuit of the adjustment circuit 52 and the control circuit 54, is configured as a hardware unit. All such combinations and variations are intended to fall within the scope of the present disclosure.

The processor 34 may be implemented as a single- or multi-chip processor, a digital signal processor (DSP), an application specific integrated circuit (ASIC), a field programmable gate array (FPGA), or other programmable logic device, discrete gate or transistor logic, discrete hardware components, or any combination thereof designed to perform the functions described herein. A processor may be a microprocessor, or, any conventional processor, or state machine. A processor also may be implemented as a combination of computing devices, such as a combination of a DSP and a microprocessor, a plurality of microprocessors, one or more microprocessors in conjunction with a DSP core, or any other such configuration. In some embodiments, the one or more processors may be shared by multiple circuits (e.g., adjustment circuit 52 and the control circuit 54 may comprise or otherwise share the same processor which, in some example embodiments, may execute instructions stored, or otherwise accessed, via different areas of memory). Alternatively or additionally, the one or more processors may be structured to perform or otherwise execute certain operations independent of one or more co-processors. In other example embodiments, two or more processors may be coupled via a bus to enable independent, parallel, pipelined, or multi-threaded instruction execution. All such variations are intended to fall within the scope of the present disclosure.

The memory device 38 (e.g., memory, memory unit, storage device) may include one or more devices (e.g., RAM, ROM, Flash memory, hard disk storage) for storing data and/or computer code for completing or facilitating the various processes, layers and modules described in the present disclosure. The memory device 38 may be communicably coupled to the processor 34 to provide computer code or instructions to the processor 34 for executing at least some of the processes described herein. Moreover, the memory device 38 may be or include tangible, non-transient volatile memory or non-volatile memory. Accordingly, the memory device 38 may include database components, object code components, script components, or any other type of information structure for supporting the various activities and information structures described herein.

The adjustment circuit 52 is structured or configured to receive signals from the inlet sensor 22 and the outlet sensor 24 indicative of the temperature (or another characteristic, such as a flow rate) of the coolant as the coolant pump 18 pumps the coolant into the engine 12 at the cold side and as the coolant exits the engine 12 at the hot side after absorbing heat from the engine 12. Based on this information, the adjustment circuit 52 may determine to adjust the coolant temperature. In some embodiments, the adjustment circuit 52 makes this determination by comparing the engine outlet coolant temperature, which is sensed by the outlet sensor 24, to a target engine outlet coolant temperature value. For instance, if the sensed engine outlet coolant temperature is above the target engine outlet coolant temperature value, then the adjustment circuit 52 determines that the coolant temperature is to be adjusted lower. Conversely, if the sensed engine outlet coolant temperature is below the target engine outlet coolant temperature value, then the adjustment circuit 52 determines that the coolant temperature is to be adjusted higher. Alternatively, if the sensed engine outlet coolant temperature is within a pre-defined range to the target engine outlet coolant temperature (e.g. ±5° C.), the adjustment circuit 52 determines that the coolant temperature does not need an adjustment. Similarly, if the sensed engine inlet coolant temperature is above the target engine inlet coolant temperature value, then the adjustment circuit 52 determines that the coolant temperature is to be adjusted lower. Conversely, if the sensed engine inlet coolant temperature is below the target engine inlet coolant temperature value, then the adjustment circuit 52 determines that the coolant temperature is to be adjusted higher. Alternatively, if the sensed engine inlet coolant temperature is within a pre-defined range to the target engine inlet coolant temperature (e.g. ±5° C.), the adjustment circuit 52 determines that the coolant temperature does not need an adjustment.

In an exemplary embodiment, the target outlet temperature value is set at a constant value, such as 90° C., regardless of engine 12 performance. In other embodiments, the target engine outlet coolant temperature value is a variable value that responds to a desired power output from the engine 12 such that the target engine outlet coolant temperature value is increased in order to compensate for the engine 12 needing to run hot in order to produce the desired power output. The target engine outlet coolant temperature value may be predefined in the adjustment circuit 52 (e.g., stored and retrieved by the adjustment circuit 52).

Figures 3A, 3B:
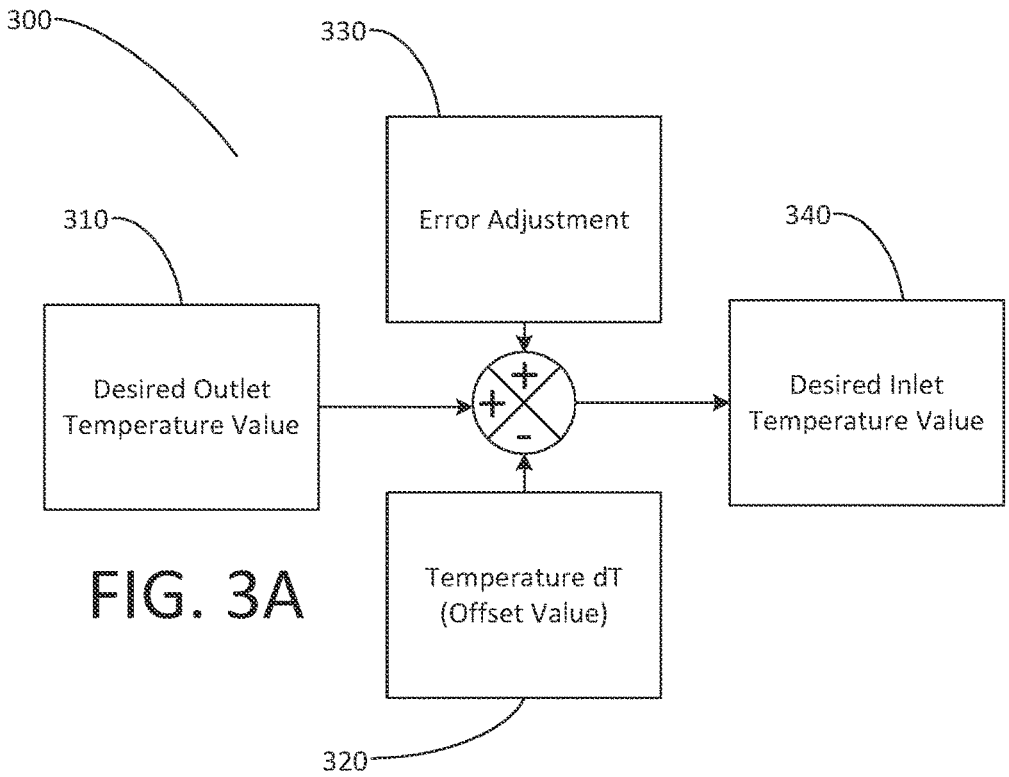
FIG. 3A is a flow diagram of a method for determining a target coolant inlet temperature based on a predefined offset value (e.g., via an offset table) for the coolant system of FIG. 1, according to an example embodiment.
FIG. 3B is an image of an example of the predefined offset value, shown as an offset table, for use with the method of FIG. 3A, according to an example embodiment.

In other embodiments, the determination as to whether an adjustment to coolant temperature is necessary is made by comparing the inlet temperature of the coolant at the inlet sensor 22 to a target inlet temperature value. In an exemplary embodiment, the target inlet temperature value is determined by utilizing an offset table in conjunction with the target outlet temperature value. This exemplary embodiment is shown in FIGS. 3A and 3B. FIG. 3A shows a target inlet temperature value process 300 for determining the target inlet temperature value based on the target outlet temperature value, an offset value, and an error adjustment. The target inlet temperature value process 300 receives the target outlet temperature value at 310, subtracts the offset value at 320, applies the error adjustment at 330, and outputs the target inlet temperature value at 340. Based on this target inlet temperature value, the adjustment circuit 52 sets an adjustment value that includes the determination from the adjustment circuit of the amount of adjustment to the coolant temperature and the direction of the adjustment (i.e. positive to a higher temperature or negative to a lower temperature). For instance, if the adjustment circuit 52 determines that the coolant temperature is to be adjusted to a higher temperature, the adjustment value is a positive value. Conversely, if the adjustment circuit 52 determines that the coolant temperature is to be adjusted to a lower temperature, the adjustment value is a negative value.

The target outlet temperature value at 310 may be set at a constant value for all modes of operation of the engine, such as 90° C. In another embodiment, the target outlet temperature value 310 may be a variable value based on operation of the engine (e.g., desired performance). Referring to FIG. 3B, the offset value at 320 is determined, in this exemplary embodiment, by a table (e.g., a lookup table) that provides a value of the amount the coolant temperature is expected to increase between the inlet sensor 22 and the outlet sensor 24 based on the detected or determined engine 12 load. The values shown in FIG. 3B are exemplary only and may differ based on an architecture of different vehicles or engine systems. For example and with reference to the exemplary table shown in FIG. 3B, if the engine 12 is operating at a load of 1000 kilowatts, coolant that is applied to the engine 12 is expected to increase in temperature by 5° C. Thus, the offset value is the value of this expected temperature increase, such that when the offset value is subtracted from the target outlet temperature value, the resultant difference is a value of the coolant temperature at the inlet sensor 22 that is expected to be at the target outlet temperature value once applied to the engine 12 operating at a given load. The error adjustment of 330 is applied to the calculation to account for steady state error present as the coolant temperature as measured or determined by the outlet sensor 24 is at the target outlet value for an extended period of time. This error adjustment, in some embodiments, throttles the total coolant temperature adjustment that the adjustment circuit 52 is signaling in order to avoid putting too much strain on the coolant system 10 and the coolant valve 16 in particular. For instance, if the adjustment circuit 52 detects that the coolant valve 16 is in the fully closed position (i.e. directing all coolant from the engine 12 to the radiator), the error adjustment of 330 may alter the target inlet temperature value at 340 in order to reduce the pressure on the coolant valve 16. This error adjustment, in another embodiment, quantifies the error found during transient operating conditions in order to avoid overcorrecting in response to momentary spikes in temperature.

Figure 4:
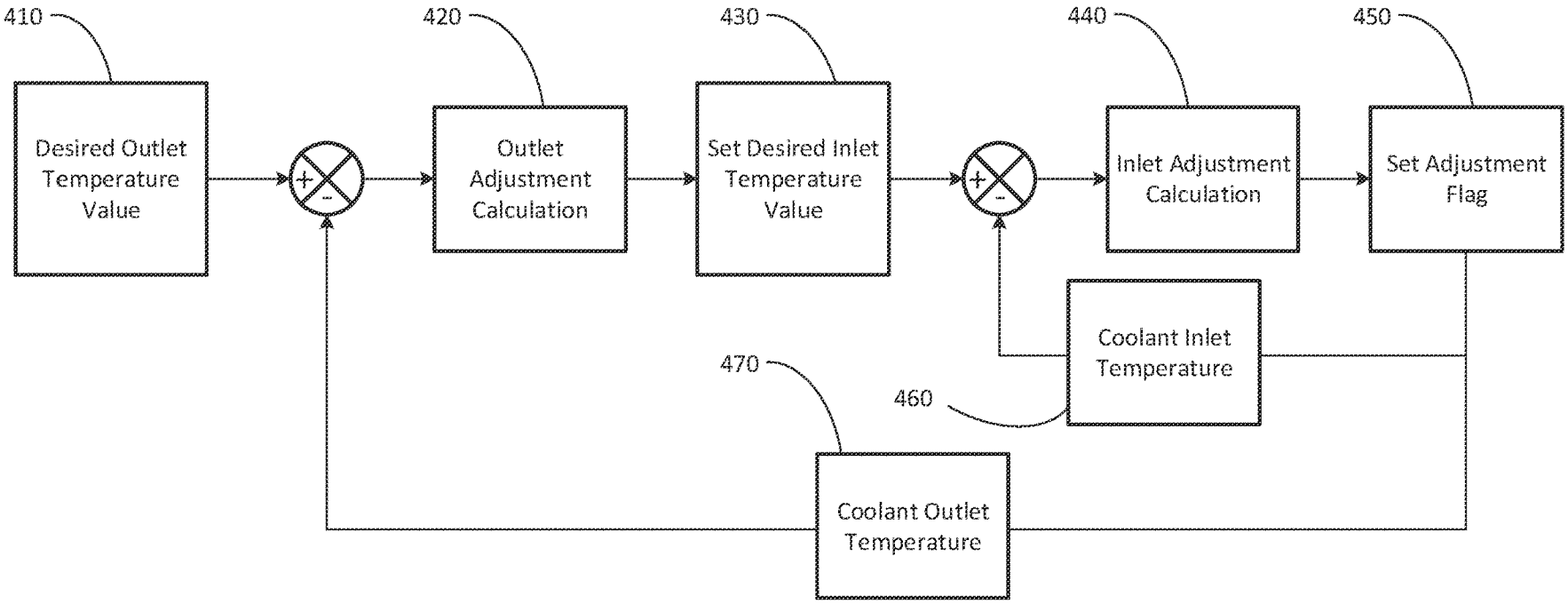
FIG. 4 is a flow diagram of a method for achieving and maintaining a target engine outlet coolant temperature using a cascade control feedback loop for a coolant system, according to an example embodiment.

In another embodiment, the adjustment circuit 52 utilizes a cascade control feedback loop in order to determine the amount of adjustment necessary for the coolant temperature. This cascade control feedback loop is shown in FIG. 4. A method for the cascade control feedback loop 400 begins when the target outlet temperature value is set at 410. Then, at step 420, the adjustment circuit 52 determines the amount of adjustment to the outlet temperature that is necessary using a control loop mechanism. This control loop mechanism may be any traditional control loop function including but not limited to proportional integral (PI), proportional derivative (PD), or proportional integral derivative (PID). This control loop function determines the necessary adjustment by continuously calculating the difference between the target outlet temperature value and the sensed outlet temperature value (from the outlet sensor 24) and determining a necessary correction. At 430, the adjustment circuit 52 sets the target inlet temperature value based on the results from the control loop mechanism of 420. Then, at 440, the adjustment circuit 52 applies another control loop mechanism to the inlet temperature. This control loop mechanism may be the same as that applied at step 420 or may be a different control loop mechanism. Finally, based on the control loop mechanisms of 420 and 440, the adjustment circuit 52 sets the adjustment value that includes the determination from the adjustment circuit of the amount of adjustment to the coolant temperature and the direction of the adjustment (i.e. positive (i.e. increasing) to a higher temperature or negative (i.e. decreasing) to a lower temperature). For instance, if the adjustment circuit 52 determines that the coolant temperature is to be adjusted to a higher temperature, the adjustment value is a positive value. Here, then, the term 'positive' refers to increasing a temperature of the coolant relative to a currently sensed coolant temperature value. Conversely, if the adjustment circuit 52 determines that the coolant temperature is to be adjusted to a lower temperature, the adjustment value is a negative value. Here, then, the term 'negative' refers to decreasing a temperature of the coolant relative to a currently sensed coolant temperature value. While the terms 'positive' and 'negative' are used, these terms are used to signify an increase or decrease, respectively, in the coolant temperature relative to the currently sensed temperature value. Throughout this method 400, the controller 26 is receiving signals from the inlet sensor 22 and the outlet sensor 24 indicative of the coolant inlet temperature at step 460 and the coolant outlet temperature at step 470 and is utilizing those data as inputs in the control loop mechanisms of 440 and 420 respectively (e.g., changing the engine loads to affect an increase or decrease in coolant temperature).

Utilizing the cascade control feedback loop enables the controller 26 to maintain a steady coolant temperature for the engine 12 in a robust manner without being derailed by system noise. This system noise can come from the following main sources: piece-to-piece noise, noise due to change over time, noise from customer usage, external environment noise, and internal noise from neighboring sub-systems. The cascade control feedback loop combats piece-to-piece noise by operating on a system-wide basis and taking into account both the engine inlet coolant and engine outlet coolant temperatures of the coolant. The continuous calculation of necessary adjustment removes or substantially removes the interference of noise due to change over time because the constant re-evaluation removes the need to re-calibrate the system every time measurements are taken. Noise due to differences in customer usage (i.e. heavy-duty wear as compared to occasional usage) may or is mostly irrelevant because the feedback loop is tied only to coolant temperature and does not take usage statistics, such as engine load or frequency of load change, into account (in contrast to the offset value of the previously described embodiment, which bases the offset value on the detected or estimate engine 12 load). The input for the feedback loop also does not include noise due to external environment. Finally, noise from neighboring sub-systems is obviated or mostly obviated due to the isolated nature of the feedback loop in that it only takes, as input, sensed temperatures from within the coolant system 10 and the coolant system 10 alone.

Both the cascade control feedback loop illustrated in FIG. 4 and the offset table method of FIG. 3A improve upon existing methods by taking into account the coolant temperature at both the inlet and the outlet of the engine 12. If the system were to rely only on the coolant outlet temperature, any changes that are made to the system are analyzed on a delay because the coolant must travel a long path from the coolant valve 16 or radiator 14 to the outlet sensor 24 in order to be measured. As such, by the time the outlet sensor 24 can report that the target temperature has been reached, the coolant valve 16 has continued to direct coolant and the coolant pump 18 has continued to pump coolant to the engine 12 and the target temperature will or likely will be overshot. Conversely, if the system were to rely only on the coolant inlet temperature, it would operate on a purely theoretical level without any grasp of how the engine 12 itself is operating because it would not be monitoring the outlet temperature, which provides an indication of the engine 12 operating status. By determining the necessary adjustments to the coolant temperature based on analysis of both the inlet coolant temperature and the outlet coolant temperature, the adjustment circuit 52 avoids the shortcomings of these systems and provides an improvement over current coolant systems.

Still referring to FIG. 2, the control circuit 54 is configured to receive an indication from the adjustment circuit 52 that the adjustment value is set and to control the coolant system 10 to adjust the coolant temperature. If the adjustment value indicates that the coolant temperature should be increased, the control circuit 54 controls the coolant valve 16 to direct coolant away from the radiator 14 and back towards the engine 12, thereby increasing a proportion of hot coolant in the coolant flow at the inlet of the engine 12, raising an overall temperature of the coolant at the inlet of the engine 12. Based on the amount of the adjustment value, the control circuit 54 will direct more or less coolant away from the radiator. For example, the greater the amount of the adjustment value, the more coolant that the control circuit 54 directs away from the radiator 14, in those situations in which the coolant temperature is to be raised, thereby increasing, to a greater extent, the proportion of hot coolant in the coolant flow at the inlet of the engine 12. If the adjustment value indicates that the coolant temperature should be decreased, the control circuit 54 controls the coolant valve 16 to direct coolant through the radiator 14 before being applied to the engine 12 via the coolant pump 18, thereby increasing a proportion of cooled coolant in the coolant flow at the inlet of the engine 12, lowering an overall temperature of the coolant at the inlet of the engine 12. Based on the amount of the adjustment value, the control circuit 54 will direct more or less coolant towards the radiator. For example, the greater the amount of the adjustment value, the more coolant that the control circuit 54 directs towards the radiator 14, in those situations in which the coolant temperature is to be lowered, thereby increasing, to a greater extent, the proportion of cooled coolant in the coolant flow at the inlet of the engine. In the alternative embodiment in which the coolant valve 16 functions as a "mixing valve," if the adjustment value indicates that the coolant temperature should be decreased, the control circuit 54 controls the coolant valve to "mix" in a greater quantity of cooled coolant from the radiator 14. This controlling, in some embodiments, takes the form of Pulse Width Modulation (PWM) that signal the coolant valve 16, which in these embodiments is a three-way valve, to rotate either clockwise or anti-clockwise, with a separate relay for each direction. In other embodiments, this controlling takes the form of a 4-20 ma signal generator, a 0-10V signal generator, a controller area network (CAN) serial communication bus, or any similar valve control method.

Figure 5:
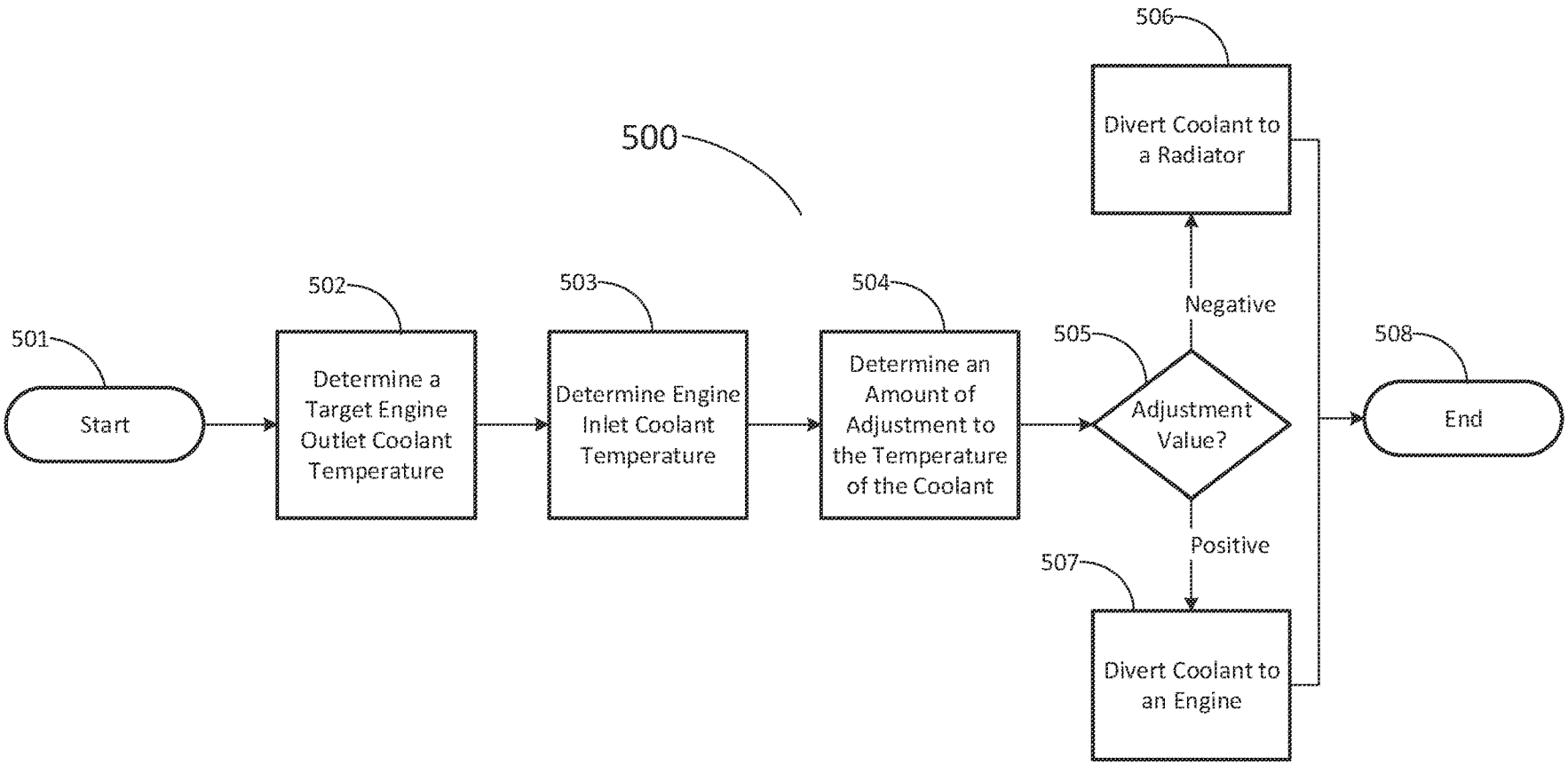
FIG. 5 is a flow diagram of a method of operating the coolant system and the engine of FIG. 1, according to an example embodiment.

Referring now to FIG. 5, a method 500 for controlling engine coolant temperature is shown, according to an example embodiment. The method 500 starts at 501 and continues at step 502, where the controller 26 determines a target engine outlet coolant temperature. Then, at step 503, the controller 26 determines an engine inlet coolant temperature, and determines, at step 504, an amount of adjustment to the temperature of the coolant. Next, at step 505, the controller 26 issues commands to or otherwise controls the coolant valve 16 to either divert the coolant to the radiator 14 at step 506 if the adjustment value is negative (i.e. signifying decreasing temperature) or divert the coolant to the engine 12 at step 507 if the adjustment value is positive (i.e. signifying increasing temperature). The method 500 ends at step 508.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using one or more separate intervening members, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic. For example, circuit A communicably "coupled" to circuit B may signify that the circuit A communicates directly with circuit B (i.e., no intermediary) or communicates indirectly with circuit B (e.g., through one or more intermediaries).

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

While various circuits with particular functionality are shown in FIG. 2, it should be understood that the controller 26 may include any number of circuits for completing the functions described herein. For example, the activities and functionalities of the adjustment circuit 52 and the control circuit 54 may be combined in multiple circuits or as a single circuit. Additional circuits with additional functionality may also be included. Further, the controller 26 may further control other activity beyond the scope of the present disclosure.

As mentioned above and in one configuration, the "circuits" may be implemented in machine-readable medium for execution by various types of processors, such as the processor 34 of FIG. 2. An identified circuit of executable code may, for instance, comprise one or more physical or logical blocks of computer instructions, which may, for instance, be organized as an object, procedure, or function. Nevertheless, the executables of an identified circuit need not be physically located together, but may comprise disparate instructions stored in different locations which, when joined logically together, comprise the circuit and achieve the stated purpose for the circuit. Indeed, a circuit of computer readable program code may be a single instruction, or many instructions, and may even be distributed over several different code segments, among different programs, and across several memory devices. Similarly, operational data may be identified and illustrated herein within circuits, and may be embodied in any suitable form and organized within any suitable type of data structure. The operational data may be collected as a single data set, or may be distributed over different locations including over different storage devices, and may exist, at least partially, merely as electronic signals on a system or network.

While the term "processor" is briefly defined above, the term "processor" and "processing circuit" are meant to be broadly interpreted. In this regard and as mentioned above, the "processor" may be implemented as one or more processors, application specific integrated circuits (ASICs), field programmable gate arrays (FPGAs), digital signal processors (DSPs), or other suitable electronic data processing components structured to execute instructions provided by memory. The one or more processors may take the form of a single core processor, multi-core processor (e.g., a dual core processor, triple core processor, quad core processor, etc.), microprocessor, etc. In some embodiments, the one or more processors may be external to the apparatus, for example the one or more processors may be a remote processor (e.g., a cloud based processor). Alternatively or additionally, the one or more processors may be internal and/or local to the apparatus. In this regard, a given circuit or components thereof may be disposed locally (e.g., as part of a local server, a local computing system, etc.) or remotely (e.g., as part of a remote server such as a cloud based server). To that end, a "circuit" as described herein may include components that are distributed across one or more locations.

Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

Although the figures and description may illustrate a specific order of method steps, the order of such steps may differ from what is depicted and described, unless specified differently above. Also, two or more steps may be performed concurrently or with partial concurrence, unless specified differently above. Such variation may depend, for example, on the software and hardware systems chosen and on designer choice. All such variations are within the scope of the disclosure. Likewise, software implementations of the described methods could be accomplished with standard programming techniques with rule-based logic and other logic to accomplish the various connection steps, processing steps, comparison steps, and decision steps.

What is claimed is:

1. A system, comprising:

a controller comprising at least one processor coupled to a memory storing instructions that, when executed by the at least one processor, cause the at least one processor to perform operations comprising:

receive a target engine outlet coolant temperature for a coolant in an engine system;

determine an adjustment to a temperature of the coolant based on an engine inlet coolant temperature and the target engine outlet coolant temperature, wherein the determination of the adjustment to the temperature of the coolant comprises utilizing a cascade control loop, the cascade control loop comprising an inner loop and an outer loop, wherein the inner loop is based on the engine inlet coolant temperature measured by an inlet sensor, and wherein the outer loop is based on an engine outlet coolant temperature measured by an outlet sensor; and alter a flow of the coolant by controlling a coolant valve in response to the determination of the adjustment to the temperature of the coolant.

2. The system of claim 1, wherein the determination of the adjustment to the temperature of the coolant comprises applying a predefined offset value to the target engine outlet coolant temperature, the predefined offset value based on a load on an engine in the engine system.

3. The system of claim 1, wherein the alteration to the flow of the coolant comprises diverting at least some of the coolant to a radiator in the engine system in response to the determination of the adjustment and that the temperature of the coolant is above a target temperature.

4. The system of claim 3, wherein the operations further comprise:

responsive to a determination that substantially all of the coolant is being diverted to the radiator, divert a portion of the coolant away from the radiator to reduce a pressure on the coolant valve.

5. The system of claim 1, wherein the alteration to the flow of the coolant comprises diverting the coolant to an engine in the engine system in response to the determination of the adjustment and that the temperature of the coolant is below a target temperature.

6. The system of claim 5, wherein a proportion of the coolant diverted to the engine is correlated to the adjustment.

7. A method of controlling engine coolant temperature, the method comprising:

receiving a target engine outlet coolant temperature for a coolant in an engine system;

determining an adjustment to a temperature of the coolant based on an engine inlet coolant temperature and the target engine outlet coolant temperature, wherein the determination of the adjustment to the temperature of the coolant comprises utilizing a cascade control loop, the cascade control loop comprising an inner loop and an outer loop, wherein the inner loop is based on the engine inlet coolant temperature measured by an inlet sensor, and wherein the outer loop is based on an engine outlet coolant temperature measured by an outlet sensor; and altering a flow of the coolant by controlling a coolant valve in response to the determination of the adjustment to the temperature of the coolant.

8. The method of claim 7, wherein determining the adjustment to the temperature of the coolant comprises applying a predefined offset value to the target engine outlet coolant temperature, the predefined offset value based on a load on an engine in the engine system.

9. The method of claim 7, wherein the alteration to the flow of the coolant comprises diverting at least some of the coolant to a radiator in the engine system in response to the determination of the adjustment and that the temperature of the coolant is above a target temperature.

10. The method of claim 9, wherein the method further comprises:

responsive to a determination that substantially all of the coolant is being diverted to the radiator, diverting a portion of the coolant away from the radiator to reduce a pressure on the coolant valve.

11. The method of claim 7, wherein the alteration to the flow of the coolant comprises diverting the coolant to an engine in the engine system in response to the determination of the adjustment and that the temperature of the coolant is below a target temperature.

12. The method of claim 11, wherein a proportion of the coolant diverted to the engine is correlated to the adjustment.

13. A non-transitory computer readable medium having computer-executable instructions embodied therein that, when executed by a computing system, causes the computing system to perform operations, the operations comprising:

receiving a target engine outlet coolant temperature for a coolant in an engine system;

determining an adjustment to a temperature of the coolant based on an engine inlet coolant temperature and the target engine outlet coolant temperature, wherein the determination of the adjustment to the temperature of the coolant comprises utilizing a cascade control loop, the cascade control loop comprising an inner loop and an outer loop, wherein the inner loop is based on the engine inlet coolant temperature measured by an inlet sensor, and wherein the outer loop is based on an engine outlet coolant temperature measured by an outlet sensor; and altering a flow of the coolant by controlling a coolant valve in response to the determination of the adjustment to the temperature of the coolant.

14. The non-transitory computer readable medium of claim 13, wherein determining the adjustment to the temperature of the coolant comprises applying a predefined offset value to the target engine outlet coolant temperature, the predefined offset value based on a load on an engine in the engine system.

15. The non-transitory computer readable medium of claim 13, wherein the alteration to the flow of the coolant comprises diverting the coolant to a radiator in the engine system in response to the determination of the adjustment and that the temperature of the coolant is above a target temperature.

16. The non-transitory computer readable medium of claim 15, wherein the operations further comprise:

responsive to a determination that substantially all of the coolant is being diverted to the radiator, diverting a portion of the coolant away from the radiator to reduce a pressure on the coolant valve.

17. The non-transitory computer readable medium of claim 13, wherein the alteration to the flow of the coolant comprises diverting the coolant to an engine in the engine system in response to the determination of the adjustment and that the temperature of the coolant is below a target temperature.

* * * * *